US007306554B2

(12) United States Patent
Couturier et al.

(10) Patent No.: US 7,306,554 B2
(45) Date of Patent: Dec. 11, 2007

(54) METHOD OF FORMING A STACK OF INTERFOLDED SHEETS OF WEB

(75) Inventors: Dennis P. Couturier, Washburn, WI (US); Greg M. Kauppila, Ashland, WI (US)

(73) Assignee: C.G. Bretting Manufacturing Co., Inc., Ashland, WI (US)

( * ) Notice: Subject to any disclaimer, the term of this patent is extended or adjusted under 35 U.S.C. 154(b) by 38 days.

(21) Appl. No.: 11/034,671

(22) Filed: Jan. 13, 2005

(65) Prior Publication Data

US 2006/0154794 A1 Jul. 13, 2006

(51) Int. Cl.
*B31F 1/08* (2006.01)

(52) U.S. Cl. ..... 493/427; 493/405; 493/411; 493/430; 493/451; 270/39.01; 270/39.02; 270/39.05

(58) Field of Classification Search ..... 493/405, 493/411, 427, 430, 451, 429, 440; 270/39.01, 270/39.02, 39.05, 39.06
See application file for complete search history.

(56) References Cited

U.S. PATENT DOCUMENTS 2,929,624 A 3/1960 Brooker
3,163,413 A 12/1964 Franke et al.
3,784,188 A 1/1974 De Ligt
4,070,014 A 1/1978 Takahashi
4,396,336 A 8/1983 Malamood
4,406,650 A 9/1983 Felix
4,475,730 A 10/1984 Trogan
4,494,741 A 1/1985 Fischer et al.
4,508,527 A 4/1985 Uno
4,650,447 A 3/1987 Meschi
4,673,382 A 6/1987 Buck et al.
4,770,402 A 9/1988 Couturier
4,874,158 A * 10/1989 Retzloff ..... 270/39.02
5,730,695 A * 3/1998 Hauschild et al. ..... 493/416
6,228,014 B1 * 5/2001 De Matteis et al. ..... 493/424
2004/0126172 A1 * 7/2004 De Matteis ..... 400/578
2004/0235633 A1 * 11/2004 De Matteis ..... 493/424

* cited by examiner

*Primary Examiner*—Hemant M. Desai
(74) *Attorney, Agent, or Firm*—Reinhart Boerner Van Deuren P.C.

(57) ABSTRACT

An interfolding apparatus including first and second interfolding rolls. The interfolding rolls issue a stream of web material to form a stack of interfolded web material. A first packer finger is movable with respect to the first interfolding roll and includes a retracted position at least partially received within the first interfolding roll and an extended position at least partially inserted into the stream of interfolded web material. A second packer finger is movable with respect to the first interfolding roll and includes a retracted position at least partially received within the first interfolding roll and an extended position at least partially inserted into the stream of interfolded web material.

18 Claims, 5 Drawing Sheets

METHOD OF FORMING A STACK OF INTERFOLDED SHEETS OF WEB

FIELD OF THE INVENTION

The present invention relates to interfolding apparatuses, and more specifically to packer systems for interfolding apparatuses.

BACKGROUND OF THE INVENTION

Numerous processes and machines exist to create folds in a stream of web material or in cut sheets issuing from a stream of web material. A typical interfolding apparatus has two rotating interfolding rolls that issue a stream of interfolded web material. One packer finger works in cooperation with each roll to create a fold in the material or sheet.

In operation, separate streams of web material are delivered to individual cutting rolls where the web material is cut into sheets. The sheets then move downward to corresponding interfolding rolls that are positioned to form a nip therebetween. The interfolding rolls rotate in opposite directions and receive the newly-cut sheets of web material from the cutting rolls.

The sheets are usually staggered with respect to the first and second interfolding rolls so that a middle portion of a first sheet of one roll passes through the nip at approximately the same time as leading and trailing edges of sheets of the opposite rolls. At this time, vacuum or mechanical grippers of the first roll grab the center of the first sheet and the leading and trailing edges of the opposing sheets to begin a fold in the first sheet and to capture the leading and trailing edges within the fold.

As the gripper rotates close to the packer finger, the force from the gripper decreases and the packer finger pushes the sheet from the interfolding roll to a position where the fold can be pressed with the leading and trailing edges of the opposing sheets being folded therebetween. This process continues alternately with the other interfolding roll to form a stack of material. In many situations, it is desirable to count out a specific number of sheets for packaging purposes. Additional fingers commonly referred to as count fingers and package building fingers can be used to separate a stack with a desired number of sheets. The count fingers are manipulated into the stack of folded web material at a specific point to define a clip having a known quantity of items.

The prior art systems generally employ the use of one packer finger per roll to create a fold in the stream of web material or sheet of web material. The size and shape of the single packer finger per roll varies in the prior art. The profile of the packer finger as well as the length can determine how much indentation or damage is inflicted on the web material, as well as the quality and location of the fold. The amount of surface area and the length of the packer finger that contacts the web material can contribute toward weakening of the web material as well as incorrect folding.

An advantage of packing the web material with a short packer finger is that the packing force exerted by the short packer finger is applied directly adjacent to the gripper portion of the interfolding roll so that very little force will be applied against the portion of the folded sheet that is upstream of the fold (i.e., the upper panel). However, it is difficult for the short packer finger to create enough friction to properly hold the previously folded sheet in place on the stack of interfolded sheets while the opposite interfolding roll is pulling the upstream portion of the sheet to the other side. If the short packer finger applies greater force on the stack of sheets to hold the previously folded sheet, the web material can be disrupted or damaged. In addition, the short packer finger is unable to properly remove air from the sheets coming off of the rotating rolls when they are being folded thereby allowing air entrapment to potentially cause damage to the sheets being folded at high speeds.

An advantage of creating a fold with a longer packer finger is that the long packer finger can create the right amount of friction to hold the previously folded sheet on the stack of interfolded sheets when the upper portion of the sheet is being tugged down by the opposing interfolding roll to form a fold. Compared to the shorter packer finger, the longer and flatter packer finger generates a larger area of friction force with the same or less force on the stack of sheets. The disadvantage to using the long packer finger is that the long packer finger pushes the sheet of web material at a location that is higher up on the rotating roll when creating a fold. This can cause the sheet of web material to stretch, tear, or become more porous. A longer packer finger provides less control over where the sheet of web material releases from the roll and therefore affects the location of the fold. Also, the longer packer finger transmits more force to the leading edge of the opposing sheet and may cause the leading edge to prematurely release from the gripper on the opposite roll.

In light of the above design limitations, a need exists for a packer finger apparatus that can overcome the limitations of the prior art. A need exists for an interfolding apparatus that has packer fingers that can quickly and precisely fold and pack a stream of web material without causing damage to the sheets. Some embodiments of the invention achieve one or more of these results.

SUMMARY OF THE INVENTION

In some embodiments, the present invention is directed to an interfolding apparatus that utilizes two packer fingers per rotating roll to create a fold in a stream of web material or in cut sheets issuing from of a stream of web material. The apparatus can include a second packer finger that is longer than a first packer finger to create a dual system of folding the sheets of web material. Using the dual system combines the advantages of a short packer finger as well as the advantages of a long packer finger.

Using a short packer finger to push a cut sheet from the first roll and create a fold is advantageous because the short finger can push the sheet of paper from the interfolding roll at a position very close to the fold to avoid stretching, tearing, or increasing the porosity of the sheet and to create folds at more precise locations. By rounding the portion of the shorter finger contacting the web material, a less detrimental effect on the web material such as marks or indention can be achieved.

By adding the use of a second, longer finger to contact the web material after the first shorter finger has made a fold can help to keep the web taut and push excess air out of the fold thereby reducing air entrapment between the interfolded sheets. The larger finger creates the necessary friction area for holding the previously folded edge against the stack while the opposite side of the interfolding apparatus is creating a fold. Because of the increased friction area, the force exerted by the longer finger onto the stack of sheets does not have to be as great as the force exerted by the short finger, thereby causing less damage to the web material.

One embodiment of the present invention is directed to an interfolding apparatus including first and second interfolding rolls. The interfolding rolls issue a stream of web material to form a stack of interfolded web material. A first packer finger is movable with respect to the first interfolding roll and includes a retracted position at least partially received within the first interfolding roll and an extended position at least partially inserted into the stream of interfolded web material. A second packer finger is movable with respect to the first interfolding roll and includes a retracted position at least partially received within the first interfolding roll and an extended position at least partially inserted into the stream of interfolded web material.

Another embodiment of the invention includes a method of forming a stack of interfolded sheets of web material. The method includes rotating first and second interfolding rolls, issuing a stream of interfolded web material from the first and second interfolding rolls, and forming a stack of interfolded web material. The method also includes moving a first packer finger with respect to the first interfolding roll between a retracted position at least partially received within the first interfolding roll and an extended position at least partially inserted into the stream of interfolded web material. In addition, the method includes moving a second packer finger with respect to the first interfolding roll between a retracted position at least partially received within the first interfolding roll and an extended position at least partially inserted into the stream of interfolded web material.

More information and a better understanding of the present invention can be achieved by referring to the following drawings and detailed description.

DETAILED DESCRIPTION

Figure 1:
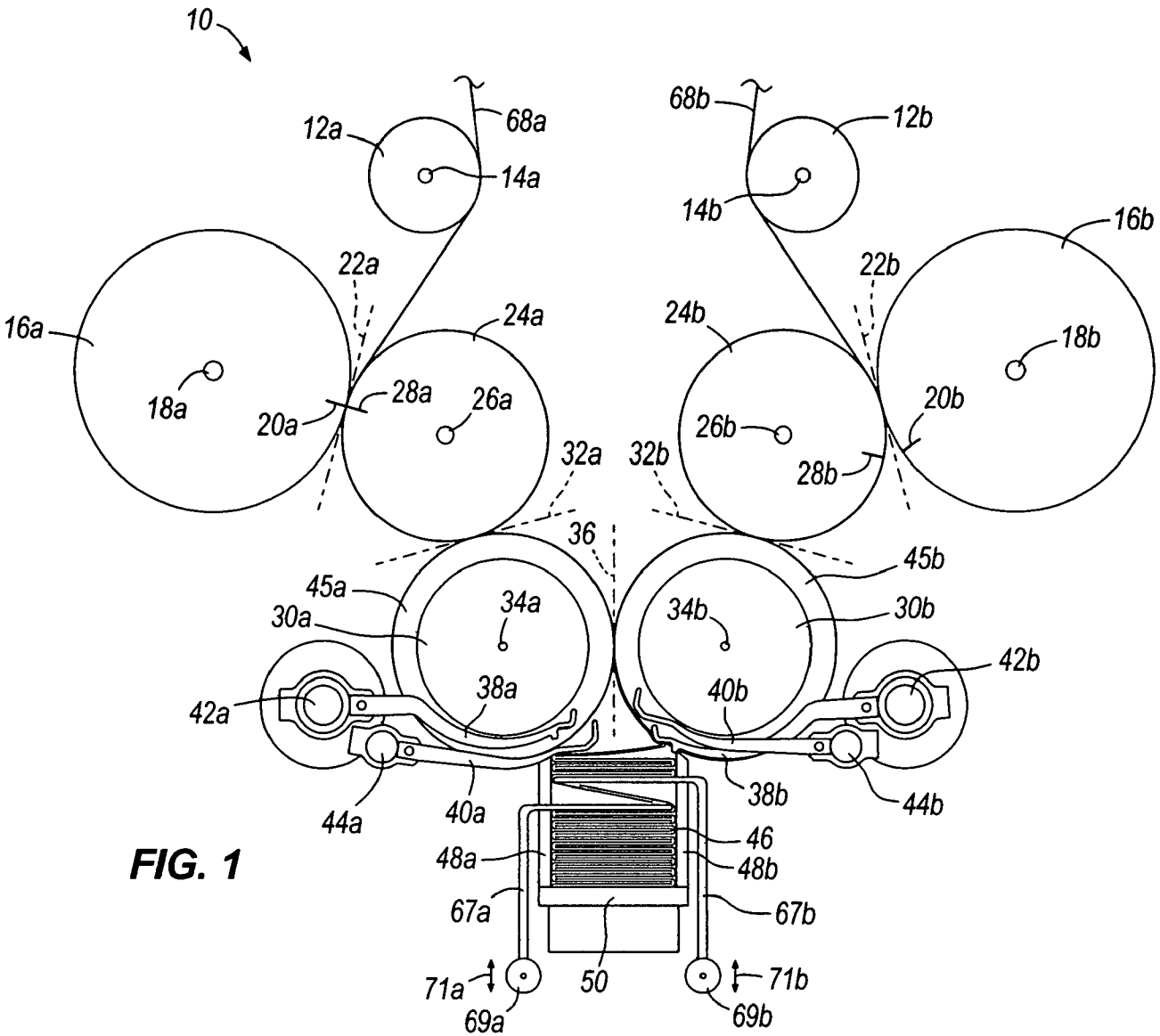
FIG. 1 is a side view illustrating an interfolding apparatus of one embodiment of the present invention.

An interfolding apparatus 10 of one embodiment of the present invention is illustrated in FIG. 1. The interfolding apparatus 10 includes two guide rolls 12*a*, 12*b* that are mounted for rotation about axes 14*a*, 14*b*. Cutting rolls 16*a*, 16*b* are mounted for rotation about axes 18*a*, 18*b*. Cutting rolls 16*a*, 16*b* contain blades 20*a*, 20*b* that pass through cutting nips 22*a*, 22*b*. Cutting nip 22*a* is formed between the cutting roll 16*a* and an opposing cutting roll 24*a* and cutting nip 22*b* is formed between the cutting roll 16*b* and an opposing cutting roll 24*b*. Cutting rolls 24*a*; 24*b* are mounted for rotation about axes 26*a*, 26*b*. Cutting rolls 24*a*, 24*b* contain anvils 28*a*, 28*b* that contact blades 20*a*, 20*b* at cutting nips 22*a*, 22*b*. The arrangements of the blades 20*a*, 20*b* and anvils 28*a*, 28*b* are used only as an example. Switching the location of the anvils 28*a*, 28*b* and the blades 20*a*, 20*b* with one another is also acceptable. An interfolding roll 30*a* forms a nip 32*a* with the cutting roll 24*a* and an interfolding roll 30*b* forms a nip 32*a* with the cutting roll 24*b*. Interfolding roll 30*a* is mounted for rotation about an axis 34*a* and interfolding roll 30*b* is mounted for rotation about an axis 34*b*. A nip 36 is formed between the interfolding rolls 30*a*, 30*b*.

Short packer finger 38*a* and long packer finger 40*a* are mounted for pivoting about axes 42*a*, 44*a* for movement between retracted positions partially within groove 45*a* of interfolding roll 30*a* and extended positions below the interfolding roll 30*a* and partially within a stream of interfolded sheets 46. Short packer finger 38*b* and long packer finger 40*b* are mounted for pivoting about axes 42*b*, 44*b* for movement between retracted positions partially within groove 45*b* of interfolding roll 30*b* and extended positions below the interfolding roll 30*b* and partially within the stream of interfolded sheets 46. Cams or servo motors (not shown) can be used to drive the short packer fingers 38*b*, 38*b* and long packer fingers 40*a*, 40*b* independently of one another. The cams can be driven by timing belts coupled to the interfolding rolls 30*a*, 30*b*. The cams can be box cams with profiles that are identical on both sides of the interfolding apparatus 10. The stack of interfolded sheets 46 is supported by guide walls 48*a*, 48*b* on the sides and by a base plate 50 from below.

Count fingers 67*a*, 67*b* are mounted for rotation about pivots 69*a*, 69*b*. Count fingers 67*a*, 67*b* are also movable in the vertical direction as indicated by arrows 71*a*, 71*b* to be reinserted into the top of the stack of interfolded sheets 46 from a lower position within the stack of interfolded sheets 46. The count fingers 67*a*, 67*b* can travel downward within the stack of interfolded sheets 46 as the stack of interfolded sheets 46 move downward with the base plate 50 when the interfolding apparatus 10 is operating. When a specific number of sheets have been folded by packer fingers 38*a*, 38*b*, 40*a*, 40*b*, one count finger will form the base and one count finger will be at the top of the specific number of sheets, thereby forming a clip. In some embodiments, the count fingers can be used in combination with package building fingers to build and pass the clips. Operation of count fingers is known to one of ordinary skill in the art and therefore is not described in detail in this patent. A more detailed description of the operation of count fingers can be found in U.S. Pat. No. 4,770,402 assigned to C. G. Bretting Manufacturing Company which is incorporated by reference into this application.

Figure 2:
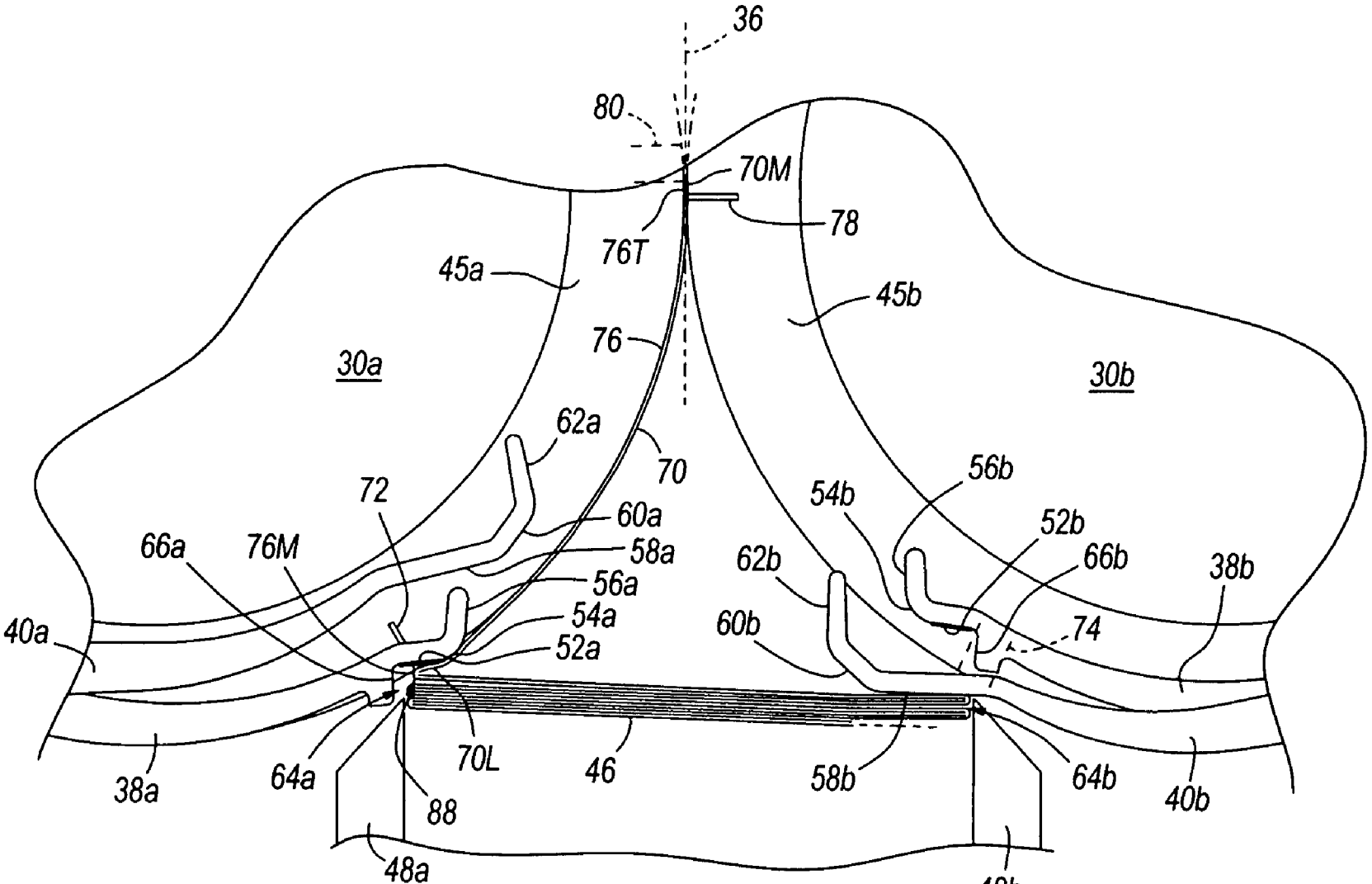
FIGS. 2-4 are enlarged side views of a double packer system of the interfolding apparatus shown in FIG. 1.

As more clearly shown in FIG. 2, the short packer fingers 38*a*, 38*b* have a shape such that the underside of the finger has a short horizontal section 52*a*, 52*b* with a curved section 54*a*, 54*b* bending into a vertical section 56*a*, 56*b*. The long packer fingers 40*a*, 40*b* have much longer flat horizontal sections 58*a*, 58*b* on the underside of the finger with approximate 45° upward bends 60*a*, 60*b* to connect to vertical sections 62*a*, 62*b*. Although terms such as "horizontal" and "vertical" are used to describe the illustrated embodiment, it is understood by one with ordinary skill in the art that components and dual packer systems can be used in any orientation and the terms "horizontal" and "vertical" are only relative to the illustration being described. The flat portions 52*a*, 52*b* are approximately half the length of the horizontal sections 58*a*, 58*b* of the long packer fingers 40*a*, 40*b*. In the extended position, the flat portions 52*a*, 52*b* contact the stack of interfolded sheets 46 extending from one side edge 64*a*, 64*b* (FIG. 2) of the stack of interfolded sheets 46 toward the middle of the stack of interfolded sheets 46. Lower vertical sections 66*a*, 66*b* on the short packer fingers 38*a*, 38*b* make contact with or nearly make contact with the sides 64*a*, 64*b* of the stack of interfolded sheets 46. Also, when the long packer fingers 40*a*, 40*b* are in the extended position, the flat portions 58*a*, 58*b* contact the stack of interfolded sheets 46 and extend approximately twice as far into the stack of interfolded sheets 46 from the sides 64*a*, 64*b* of the stack of interfolded sheets 46 as the flat portions 52*a*, 52*b*. The overall length of the long packer fingers 40*a*, 40*b* may be the same size as, longer than, or shorter than the short packer fingers 38*a*, 38*b* depending on the location of pivots, 42*a*, 42*b*, 44*a*, 44*b*. However the terms "long" and "short" in reference to packer fingers are directed to the length of the flat portion that is in contact with the stack of interfolded sheets 46. In addition, "long" and "short" fingers can be distinguished by the distance the entire packer finger extends across the stack of sheets from the corresponding side edge 64*a*, 64*b* of the stack of sheets 46.

As shown in FIG. 1, the interfolding apparatus 10 is capable of folding and stacking a stream of continuously flowing web material. The interfolding apparatus 10 can be divided into two sides that are mirror images of one another. Therefore, only a first side "a" will be described in detail, with the understanding that a second side "b" performs the same functions, only that the movement is opposite to that of the first side. For example clockwise rotation of a roll on the "a" side would mean that the complementary roll on the "b" side would have counterclockwise rotation.

A stream of web material 68*a* is issued from a supply roll (not shown) to an inner side of guide roll 12*a*. Guide roll 12*a* rotates clockwise about axis 14*a* and allows the stream of web material 68*a* to enter the nip 22*a* between the cutting rolls 16*a*, 24*a*. In this embodiment, there is one blade 20*a*. However, there may be one or more blades 20*a* on the periphery of the blade cutting roll 16*a*, depending on the size of the cutting roll 16*a*, the desired size of the sheets that are to be cut from the stream of web material 68*a*, or the rotational speed of the cutting roll 16*a*. Likewise, the number of and positioning of anvils 28*a* on the cutting roll 24*a* can vary. The blade 20*a* serves to cut the stream of web material into a sheet at the point of contact between the cutting rolls 16*a*, 24*a*. The stream of web material 68*a* is transferred to the cutting roll 24*a* through the use of vacuum ports (not shown) located along the periphery of the cutting roll 24*a*. When the stream of web material 68*a* passes through the nip 22*a*, a cut is made to form a new sheet and the vacuum ports on the cutting roll 24*a* draw the cut sheet of web material to the outside of the cutting roll 24*a*. The vacuum port carries the cut sheet to the nip 32*a* between the interfolding roll 30*a* and the cutting roll 24*a*.

Referring to FIG. 2, the details of the folding operation will be discussed making reference to both sides "a" and "b" of the interfolding apparatus 10. As the vacuum port on cutting rolls 24*a*, 24*b* bring the cut sheets of web material toward the nips 32*a*, 32*b*, the vacuum ports lose suction (i.e., controlled decay of vacuum force) and the sheets are drawn to vacuum ports 74, 80, 84 on the interfolding rolls 30*a*, 30*b*. Grippers 72, 78, 86 are located on the periphery of interfolding rolls 30*a*, 30*b* in a slightly downstream offset position from the vacuum ports 74, 80, 84 on the opposite roll. The grippers 72, 78, 86 on the interfolding rolls can be either mechanical or vacuum grippers. The gripper 72 on interfolding roll 30*a* is illustrated after grabbing the leading edge 70L of sheet 70 from the vacuum port 74 while traveling through nip 36. The leading edge 70L of sheet 70 was captured by gripper 72 through a middle portion 76M of sheet 76 with respect to interfolding roll 30*a*. As FIG. 2 illustrates, the leading edge 70L of sheet 70 is being folded within the middle portion 76M of sheet 76.

Figure 3:
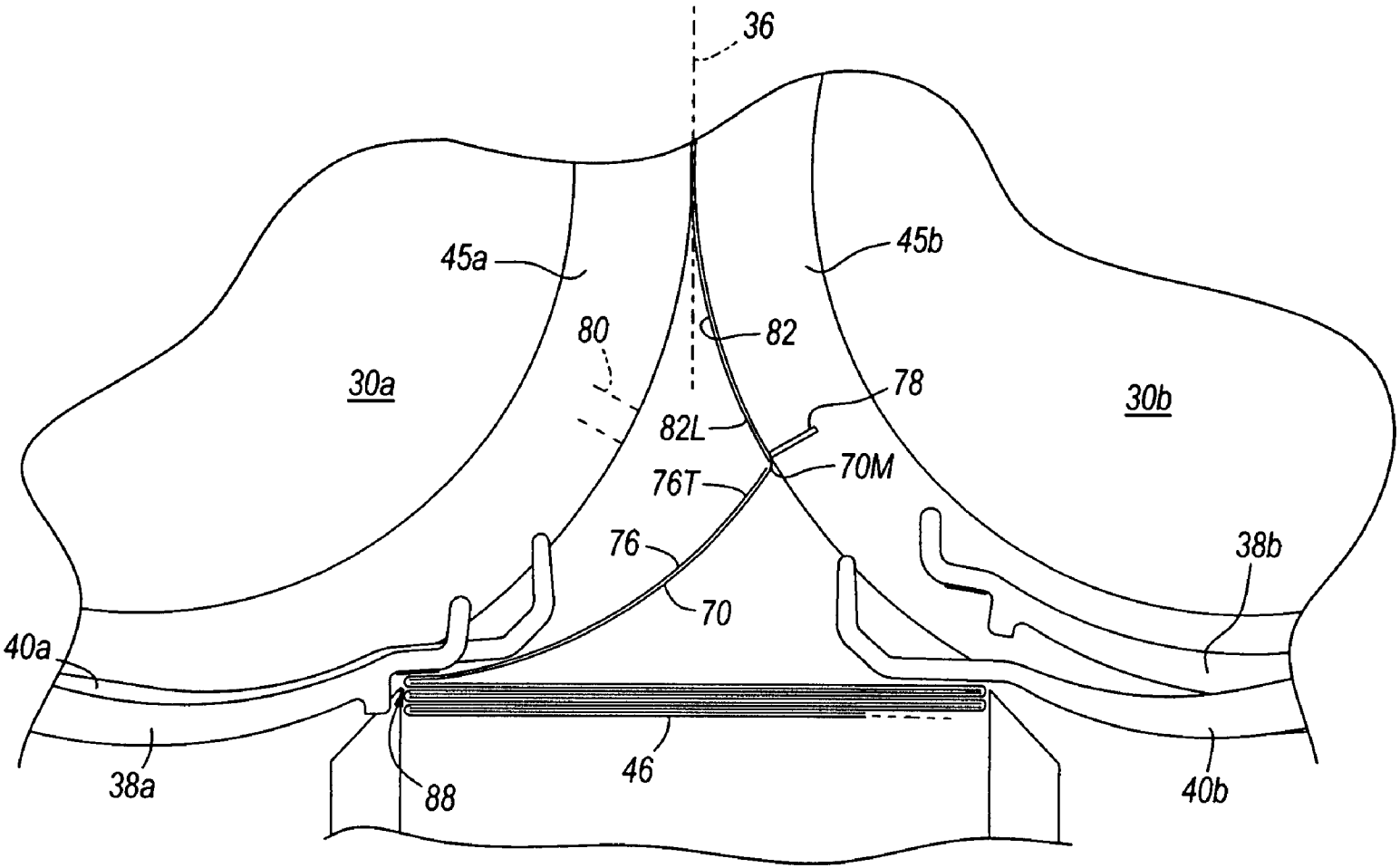

FIG. 2 illustrates gripper 78 adjacent the nip slightly downstream from vacuum port 80. At this position, the gripper 78 grabs the middle portion 70M of sheet 70 as well as a trailing edge 76T of sheet 76. With reference to FIG. 3, the interfolding rolls 30*a*, 30*b* rotate and the vacuum port 80 that once held onto a leading edge 82L of a sheet 82 has weakened enough to allow the gripper 78 to grasp the leading edge 82L of sheet 82, the middle portion 70M of sheet 70, and the trailing edge 76T of sheet 76.

Figure 4:
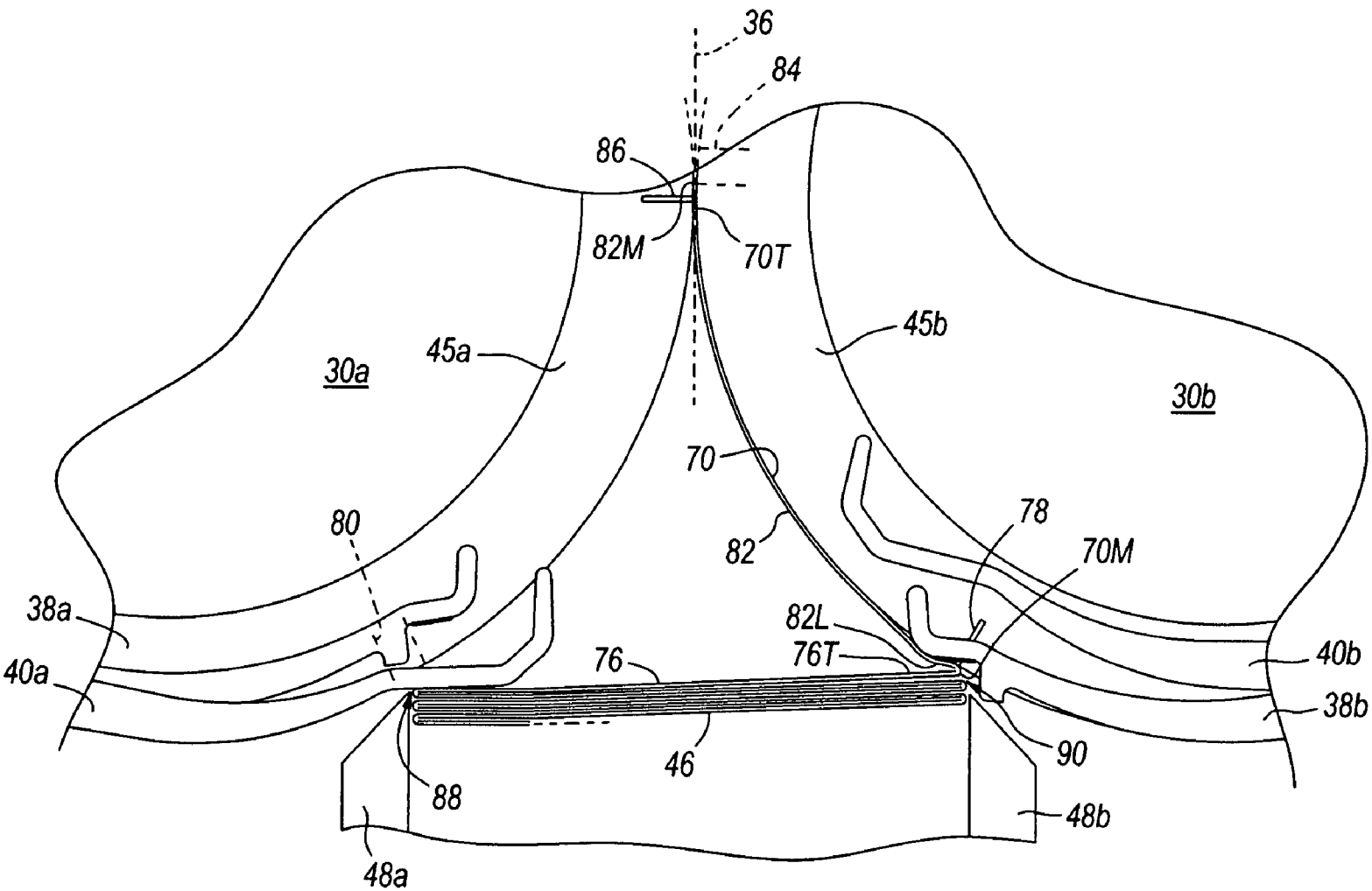

Referring now to FIG. 4, a further stage of rotation of the interfolding rolls 30*a*, 30*b* is shown. Gripper 78 has brought the trailing edge 76T, the middle portion 70M and the leading edge 82L toward guide wall 48*b* and the stack of interfolded sheets 46. Another vacuum port 84 is shown on interfolding roll 30*b* along with gripper 86. Gripper 86 will eventually grab the trailing edge 70 T of sheet 70, the middle portion 82M of sheet 82, and the leading edge of a sheet (not shown) immediately following sheet 70 issuing from cutting roll 24*b*.

Referring back to FIG. 2, a fold 88 forms at the location where the gripper 72 passes by the guide wall 48*a* and the stack of interfolded sheets 46. The long packer finger 40*a* on side "a" is in a retracted position within the groove 45*a* of the interfolding roll 30*a* while the short packer finger 38*a* is in an extended position partially extended onto the middle portion 76M of sheet 76 and the leading edge 70L of sheet 70 and the trailing edge of the sheet immediately downstream. On the second side, the long packer finger 40*b* is fully extended and applies a force onto the stack of interfolded sheets 46. The short packer finger 38*b* is in a retracted position partially received within the groove 45*b* of the interfolding roll 30*b*. The long packer finger 40*b* is serving to create a frictional force to stabilize the stack of interfolded sheets 46 as the short packer finger 38*a* is beginning to detach the first sheet 76 and a leading edge 70L of the second sheet 70 from the gripper portion 72.

The short packer finger 38*a* has a curved profile 54*a* at the location where the short packer finger 38*a* contacts the sheets 76, 70 of web material issuing from interfolding roll 30*a*. The curved profile 54*a* prevents the short packer finger 38*a* from causing damage to the sheets 76, 70 of web material when the sheets 76, 70 are being pulled off of the gripper 72 by the short packer finger 38*a*. The relatively longer flat profile 58*a* of the long packer finger 40*a* contacts the stack of interfolded sheets 46 and increases the stability of the stack of interfolded sheets 46. The long horizontal flat profile 58*a* on the long packer finger 40*a* increases the surface area acting on the stack 46 and therefore increases the frictional force acting between the long packer finger 40*a* and the stack of interfolded sheets 46.

As shown in FIG. 1, a distinction can be made between count finger 67*a* and packer fingers 38*a*, 40*a* in that packer fingers 38*a*, 40*a* will directly contact every sheet issuing from interfolding roll 30*a*. In addition, packer fingers 38*b*, 40*b* will directly contact every sheet issuing from interfolding roll 30*b*. Count fingers 67*a*, 67*b* will generally only contact a very small percentage of the sheets within the stack depending upon the desired sizes of the clips (e.g. every hundredth sheet).

As shown in FIG. 2, the first sheet 76 has a trailing edge 76T and sheet 70 has a middle portion 70M. The trailing edge 76T and the middle portion 70M are held by gripper 78. As interfolding roll 30*b* rotates, the gripper portion 78 will move toward the guide wall 48*b* and the stack of interfolded sheets 46.

FIG. 3 shows the progression of rotation of interfolding rolls 30*a*, 30*b*. The short packer finger 38*a* begins to retract away from the stack of interfolded sheets 46 after the fold 88 has been made. The long packer finger 40*a* is now extending to hold the fold 88 made by the short packer finger 38*a* and push the entrapped air out of the fold 88 to keep the web taut. On the opposite side, the long packer finger 40*b* is beginning to retract away from the stack of interfolded sheets 46 while the short packer finger 38*b* is in a completely retracted position, ready to make the next fold. Gripper 78 is approaching packer fingers 38*b*, 40*b* while grabbing the leading edge 82L of sheet 82, the middle portion 70M of sheet 70, and the trailing edge 76T of sheet 76.

FIG. 4 shows the rotation of interfolding roll 30*b* as gripper 78 has moved further toward the guide wall 48*b* and the stack of interfolded sheets 46. The short packer finger 38*b* extends partially into the sheets 70, 82 of web material to push the sheet 70 away from the gripper 78. The long packer finger 40*b* is partially retracted within the interfolding roll 30*b*. The long packer finger 40*a* is completely extended and creates friction on the first side of the stack of interfolded sheets 46. The long packer finger 40*a* also provides support and stability along with guide walls 48*a*, 48*b* positioned on both sides of the stack of interfolded sheets 46. Similar to the packer finger 38*a* in FIG. 3, the short packer finger 38*b* will eventually completely extend to create a fold 90 on the second side of the interfolding apparatus 10. The fold 90 will occur at the middle portion 70M of sheet 70 while capturing the trailing edge 76T of sheet 76 and the leading edge 82L of sheet 82 within the fold. Through approximately 30° of rotation after the short packer finger 38*b* is moved to the extended position, the long packer finger 40*b* assists in bringing the remainder of the sheet 70 and the leading edge 82L of sheet 82 onto the stack of interfolded web material 46. Gripper 86 will begin the process of creating another fold on side "a" above fold 88. The fold will be located at the middle portion 82M of sheet 82 while enfolding the trailing edge 70T of sheet 70 and the leading edge of the sheet (not shown) directly following sheet 70 on interfolding roll 30*b*.

In the preferred embodiment, the long packer finger 40*a* pivots after the short packer finger 28*a* and after approximately 30° of rotation of the interfolding rolls 30*a*, 30*b*. For example, when the short packer finger 38*a* completely extends and creates a fold on the top of the stack of interfolded sheets 46, the long packer finger 40*a* is in the retracted position away from the stack of interfolded sheets 46. After 30° of rotation of the interfolding roll 30*a*, the long packer finger 40*a* will be fully extended and in contact with the stack of interfolded sheets 46. The specific angle given for the lag of the long packer finger 40*a* behind the short packer finger 38*a* is in no way limiting or specific to this invention. Alternate degrees of lag will prove successful, and a 30° angle is solely used as an example.

Figure 5:
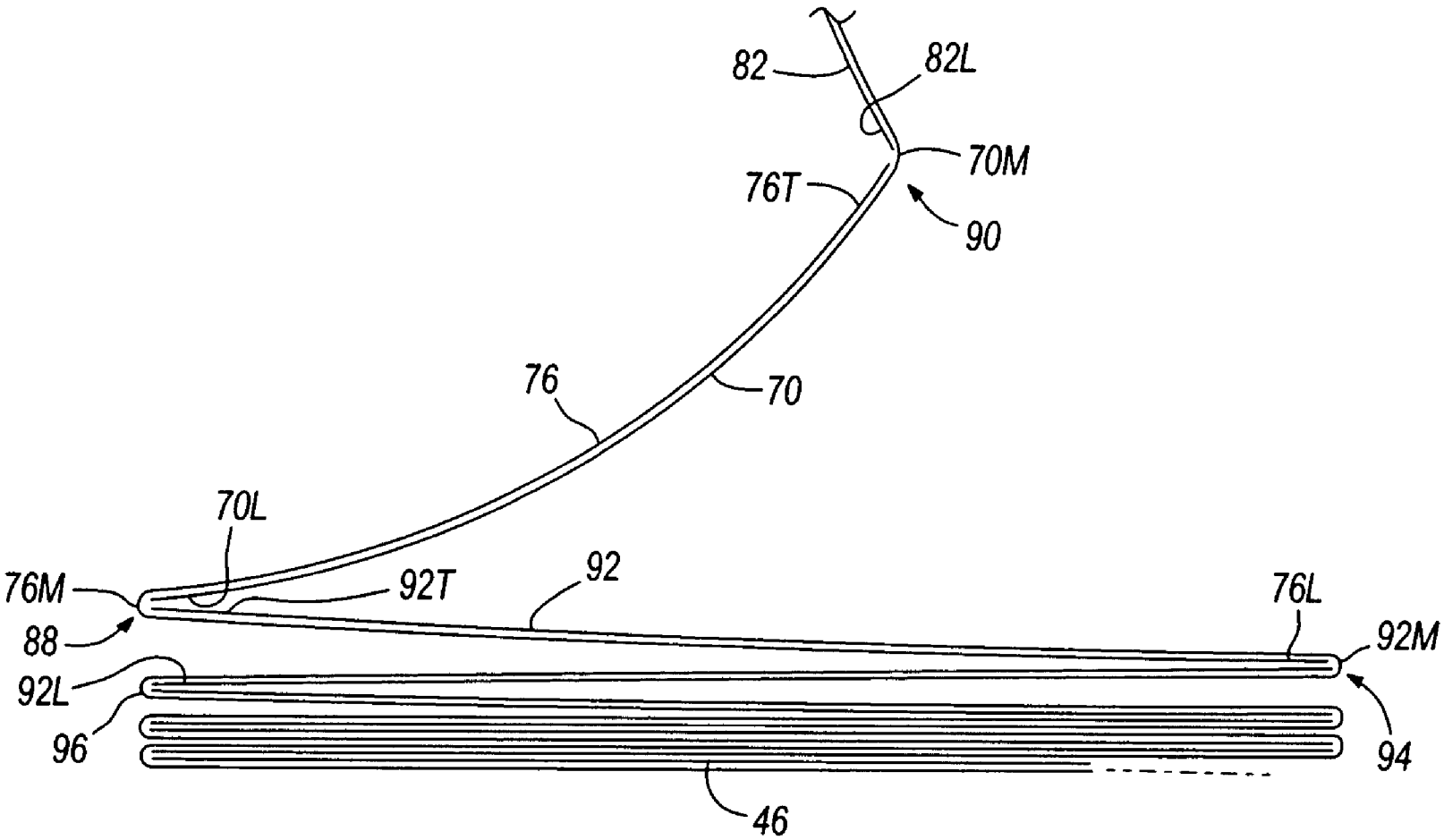
FIG. 5 is an enlarged side view of interfolded sheets of the interfolding apparatus shown in FIG. 1.

FIG. 5 displays a close-up of the interfolding that occurs between the two separate streams of web material 68*a*, 68*b* that have been cut into sheets. A close-up of the interfolded stack of sheets 46 of FIG. 3 is shown. A first sheet 92 has been issued from interfolding roll 30*b* (not shown) and has trailing edge 92T captured within fold 88, middle portion 76M creating a fold 94, and leading edge 92L within a fold 96. A second sheet 76 that has been issued from interfolding roll 30*a* (not shown) has leading edge 76L within fold 94, middle portion 76M creating fold 88, and trailing edge 76T within a newly forming fold 90. The next sheet 70 issued from interfolding roll 30*b* has a leading edge 70L within fold 88, a middle portion 70M creating fold 90 and a trailing portion (not shown) that will be on the inside of the next fold. A fourth sheet 82 has a leading edge 82L in fold 90 with the rest of the sheet (not shown) following the pattern established by the first three sheets.

The constructions and aspects described above and illustrated in the drawings are presented by way of example only and are not intended as a limitation upon the concepts and principles of the present invention. As such, it will be appreciated by one having ordinary skill in the art, that various changes in the elements and their configuration and arrangement are possible without departing from the spirit and scope of the present invention as set forth in the claims.

We claim:

1. A method of forming a stack of interfolded sheets of web material, the method comprising:

rotating first and second interfolding rolls;

issuing a stream of interfolded web material from the first and second interfolding rolls;

forming a stack of interfolded web material;

moving a first packer finger with respect to the first interfolding roll between a retracted position at least partially received within the first interfolding roll and an extended position at least partially inserted into the stream of interfolded web material; and moving a second packer finger with respect to the first interfolding roll between a retracted position at least partially received within the first interfolding roll and an extended position at least partially inserted into the stream of interfolded web material, the first packer finger and the second packer finger alternating to both contact each interfolded sheet in the stream of interfolded web material issued from the first interfolding roll.

2. The method of claim 1, further comprising:

moving a third packer finger with respect to the second interfolding roll between a retracted position at least partially received within the second interfolding roll and an extended position at least partially inserted into the stream of interfolded web material; and moving a fourth packer finger with respect to the second rotating roll between a retracted position at least partially received within the second interfolding roll and an extended position at least partially inserted into the stream of interfolded web material.

3. The method of claim 1, further comprising:

drawing a first sheet from the stream of web material to the first interfolding roll;

pushing the first sheet away from the first interfolding roll and toward the stack of interfolded web material by moving the first packer finger to the extended position; and creating a fold between the leading and trailing edges by moving the first packer finger to the extended position.

4. The method of claim 3, further comprising:

pushing the upstream panel away from the first interfolding roll toward the stack of interfolded web material by moving the first packer finger to the extended position.

5. The method of claim 4, further comprising:

moving the second packer finger to the extended position after the first packer finger is moved to the extended position.

6. The method of claim 4, further comprising:

drawing a second sheet from the stream of web material to the second interfolding roll; and holding the upstream panel of the first sheet against the stack of interfolded web material while drawing the second sheet to the second interfolding roll.

7. The method of claim 1, further comprising:

moving the first and second packer fingers independently of each other.

8. The method of claim 1, further comprising:

moving a first count finger to form a base for the stack of interfolded web material.

9. The method of claim 8, further comprising:

moving a second count finger to at least partially within the stream of interfolded web material, the first count finger and the second count finger forming a clip of interfolded web material.

10. A method of forming a stack of interfolded sheets of web material, the method comprising:

rotating a first interfolding roll;

conveying a first sheet of web material with the first interfolding roll;

rotating a second interfolding roll;

conveying a second sheet of web material with the second interfolding roll;

interfolding the sheets to form a stack of interfolded sheets;

contacting the first sheet with the second sheet;

at least one of retracting two packer fingers at least partially into the first interfolding roll and retracting an additional two packer fingers at least partially into the second interfolding roll;

altemating the two packer fingers to each contact the first sheet; and alternating the additional two packer fingers to each contact the second sheet.

11. The method of claim 10, further comprising:

moving one of the two packer fingers to push the first sheet away from the first interfolding roll and toward the stack of interfolded sheets to create a fold between leading and trailing edges of the first sheet.

12. The method of claim 11, further comprising:

moving the other of the two packer fingers to push an upstream panel of the first sheet away from the first interfolding roll toward the stack of interfolded sheets.

13. The method of claim 11, further comprising:

moving one of the two packer fingers after the other of the two packer fingers is moved.

14. The method of claim 12, further comprising:

holding the upstream panel of the first sheet with one of the two packer fingers against the stack of interfolded sheets while conveying the second sheet with the second interfolding roll.

15. The method of claim 14, wherein the leading edge of the second sheet is adjacent to the fold of the first sheet.

16. The method of claim 14, further comprising:

holding the upstream panel against the stack of interfolded sheets with a flat portion of at least one of the packer fingers having a flat portion.

17. The method of claim 10, further comprising:

moving the two packer fingers independently of each other.

18. The method of claim 10, further comprising:

inserting count fingers into the stack of interfolded web material.

* * * * *